US009896254B2

(12) United States Patent
Yourist et al.

(10) Patent No.: US 9,896,254 B2
(45) Date of Patent: Feb. 20, 2018

(54) MULTI-SERVE HOT FILL TYPE CONTAINER HAVING IMPROVED GRIPPABILITY

(75) Inventors: Sheldon E. Yourist, York, PA (US); Raymond A. Pritchett, Jr., Manchester, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 1104 days.

(21) Appl. No.: 12/908,079

(22) Filed: Oct. 20, 2010

(65) Prior Publication Data

US 2012/0097635 A1 Apr. 26, 2012

(51) Int. Cl.

| | |
|---|---|
| ***B65D 90/02*** | (2006.01) |
| ***B65D 79/00*** | (2006.01) |
| ***B65D 1/02*** | (2006.01) |
| ***B65D 23/08*** | (2006.01) |
| ***B65D 23/10*** | (2006.01) |

(52) U.S. Cl.

CPC ..... *B65D 79/005* (2013.01); *B65D 1/0276* (2013.01); *B65D 23/0878* (2013.01); *B65D 23/102* (2013.01); *B65D 2501/0036* (2013.01)

(58) Field of Classification Search

CPC ..... B65D 79/005; B65D 1/0276; B65D 23/0878; B65D 23/102; B65D 2501/0036

USPC ..... 215/381

See application file for complete search history.

(56) References Cited

U.S. PATENT DOCUMENTS

| | | | | |
|---|---|---|---|---|
| 3,871,541 | A | 3/1975 | Adomaitis | |
| D315,678 | S | 3/1991 | Darr | |
| 5,303,834 | A * | 4/1994 | Krishnakumar et al. | 215/381 |
| 5,704,503 | A * | 1/1998 | Krishnakumar et al. | 215/381 |
| 5,732,838 | A | 3/1998 | Young | |
| 6,044,996 | A * | 4/2000 | Carew et al. | 215/381 |
| 6,273,282 | B1 * | 8/2001 | Ogg et al. | 215/381 |
| 6,554,146 | B1 * | 4/2003 | DeGroff et al. | 215/381 |
| 6,575,320 | B2 * | 6/2003 | Ota et al. | 215/381 |
| D476,894 | S * | 7/2003 | Masotta et al. | D9/503 |
| D478,278 | S * | 8/2003 | Masotta et al. | D9/530 |
| 6,763,969 | B1 | 7/2004 | Melrose et al. | |
| 6,779,673 | B2 | 8/2004 | Melrose et al. | |
| 6,837,390 | B2 | 1/2005 | Lane et al. | |

(Continued)

*Primary Examiner* — Tri Mai

(74) *Attorney, Agent, or Firm* — Baker Botts L.L.P.

(57) ABSTRACT

A round, hot fillable plastic container includes an upper portion defining an opening; a bottom portion; and a main body portion having a plastic sidewall that has a plurality of vacuum panels defined therein. The main body portion has a generally hourglass shape with a central portion that is narrower than upper and lower portions thereof. The hourglass shape optimizes grippability of the container. Grippability is optimized further by the presence of indentations that are formed between columns that define the hourglass shape and pillow portions that are provided for finger support. The indentations permit a consumer to gain finger traction and purchase with respect to the container body, even when a label is positioned between the container body and the user's fingers. The main body portion further has a first groove defined in the upper portion thereof, a second groove defined in the lower portion thereof and a third groove that is defined in the central portion thereof. The grooves provide dimensional stability during handling and when the main body portion is gripped by a consumer.

24 Claims, 8 Drawing Sheets

(56) References Cited

U.S. PATENT DOCUMENTS

| | | | | |
|---|---|---|---|---|
| 6,929,138 | B2 | 8/2005 | Melrose et al. | |
| 7,021,479 | B2 * | 4/2006 | Pedmo et al. | 215/381 |
| D535,563 | S * | 1/2007 | Martin | D9/500 |
| 7,178,684 | B1 | 2/2007 | Budden et al. | |
| D556,595 | S | 12/2007 | Rucinski | |
| D595,135 | S * | 6/2009 | Goetz | D9/500 |
| 7,581,654 | B2 | 9/2009 | Stowitts | |
| D602,788 | S * | 10/2009 | Priore et al. | D9/667 |
| D647,404 | S * | 10/2011 | Yourist et al. | D9/538 |
| 8,100,278 | B2 * | 1/2012 | Dlouhy | 215/383 |
| 2002/0000421 | A1 * | 1/2002 | Ota et al. | 215/381 |
| 2005/0269284 | A1 * | 12/2005 | Pedmo et al. | 215/381 |
| 2005/0284840 | A1 * | 12/2005 | Pedmo et al. | 215/381 |
| 2007/0090083 | A1 | 4/2007 | Trude | |
| 2008/0041812 | A1 | 2/2008 | Stowitts | |
| 2008/0257856 | A1 * | 10/2008 | Melrose et al. | 215/381 |
| 2010/0155359 | A1 * | 6/2010 | Simon et al. | 215/382 |

* cited by examiner

MULTI-SERVE HOT FILL TYPE CONTAINER HAVING IMPROVED GRIPPABILITY

BACKGROUND OF THE INVENTION

1. Field of the Invention

This invention relates generally to the field of plastic containers, and more particularly to plastic containers that are designed to accommodate volumetric expansion and contraction such as that inherent to the hot-fill packaging process or to packaging applications where internal pressurization is anticipated.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid or semi-solid product such as fruit juice, sauce, salsa, jelly or fruit salad is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling. Several vacuum panels are typically provided, with integral column structures interposed between the respective vacuum panels. The vacuum panel regions of conventional hot fill containers are usually recessed with respect to the adjacent columns. Hot fill containers are typically fabricated using PET, but alternatively can be fabricated using a material such as polypropylene using an extrusion blow molding process.

In many cases, the needs of a manufacturer require that a label be secured to the container over the vacuum panels. In order to avoid excessive crinkling or deformation of the label when the container is squeezed or when volumetric expansion or contraction occurs within the container, it is important that the vacuum panels and the container as a whole be designed to provide as much support for the label as possible. In some cases, one or more raised areas are provided within the vacuum panel for improved label support. These are typically referred to as pillows or islands.

Smaller hot fill containers, typically those under 32 ounces in volume, are commonly referred to as single serve containers in the industry as the entire contents of the container can be consumed by a user at one time. Containers that are 32 ounces and larger are typically referred to as multi-serve containers. These include large juice containers, with common volumetric sizes being 32 ounces, 48 ounces, 64 ounces, 96 ounces, and even a gallon. Design considerations that are present in the engineering of larger, multi-serve containers can be substantially different than those that are taken into account for smaller, single serve containers.

Grippability is an important design consideration in the engineering of such containers. In larger, multi-serve containers grippability has often been enhanced by providing a pair of deep vacuum panels that can also serve as gripping points for a consumer when picking the container up and handling the container during pouring. However, when a product manufacturer desires a large, multi-serve container to which a shrink fit label will be applied, the use of such deep vacuum panels is impractical because the label will bridge the recesses that are defined by the vacuum panels and render them inaccessible for gripping the container. In addition, certain product manufacturers prefer round containers, i.e. containers that are substantially circular in transverse cross-section at their widest dimensions, and it is difficult to implement certain types of gripping recesses in a circular container. Accordingly, designing a large, multi-serve container that is simultaneously suitable for use with a shrink fit label and that possesses adequate grippability for a consumer has been problematic, particularly in a round container.

A need exists for an improved round, multi-serve hot fillable container that provides superior grippability and that is suitable for use with shrink fit labeling.

SUMMARY OF THE INVENTION

Accordingly, it is an object of the invention to provide an improved round, multi-serve hot fillable container to provide superior grippability and that is suitable for use with shrink fit labeling.

In order to achieve the above and other objects of the invention, a round, hot fillable plastic container according to a first aspect of the invention includes an upper portion defining an opening and a bottom portion. The container further includes a main body portion having a plastic sidewall that has a plurality of vacuum panels defined therein. The main body portion has a generally hourglass shape with a central portion that is narrower than upper and lower portions thereof. The main body portion further has a first groove defined in the upper portion thereof, a second groove defined in the lower portion thereof and a third groove that is defined in the central portion thereof, whereby dimensional stability of the container is retained during handling and when the main body portion is gripped by a consumer.

A round, hot fillable plastic container according to a second aspect of the invention includes a plastic sidewall defining an interior space and defining an internal volume of the container that is at least about 32 ounces. The sidewall defines a main body portion having a generally hourglass shape with a central portion that is narrower than upper and lower portions thereof. The main body portion further has a first groove defined in the upper portion of the main body portion, a second groove defined in the lower portion of the main body portion and a third groove that is defined in the central portion of the main body portion. An upper gripping surface having a first plurality of vacuum panels is defined between the first groove and the third groove and a lower gripping surface having a second plurality of vacuum panels is defined between the second groove and the third groove. A label is mounted on the plastic sidewall so as to conform to the main body portion.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
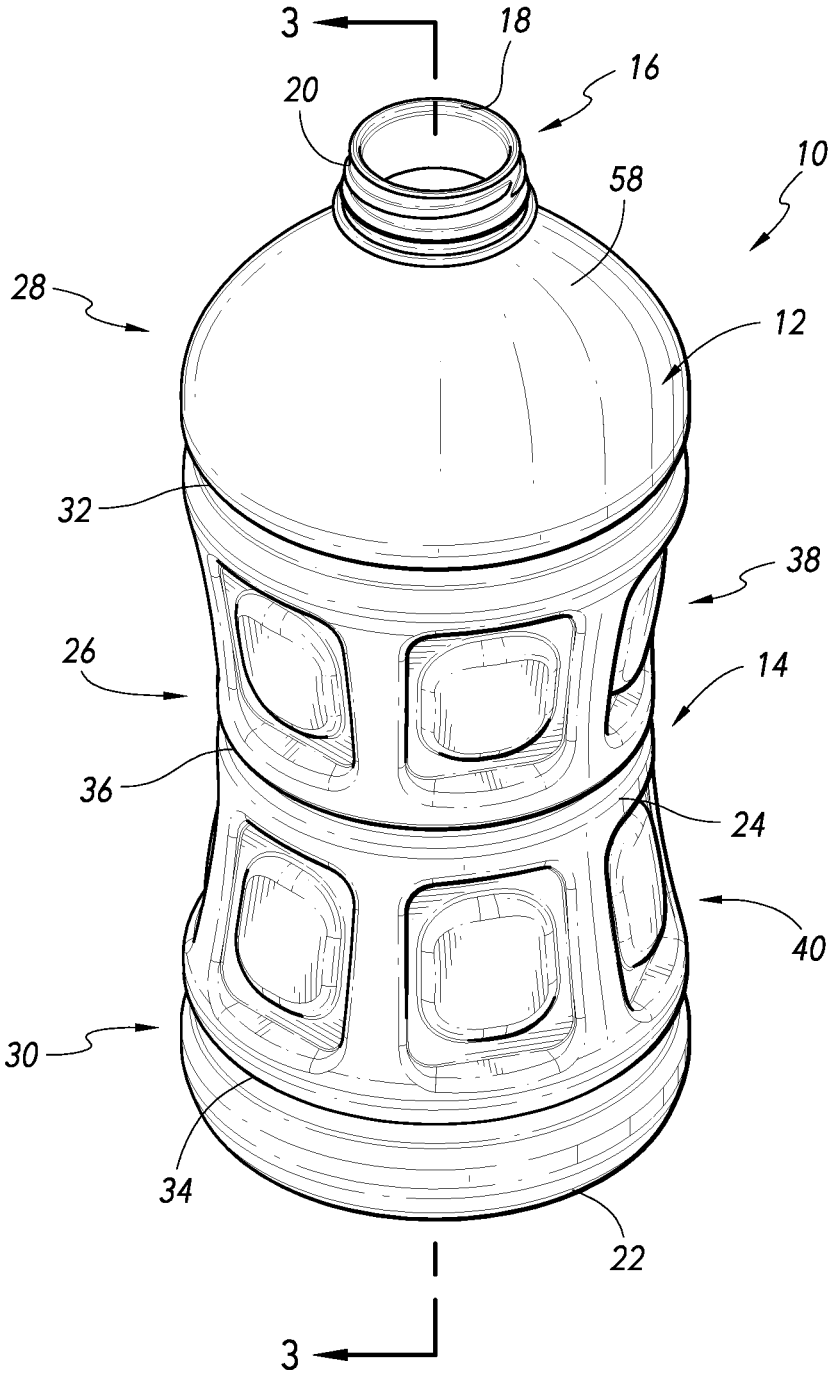
FIG. 1 is a perspective view of a plastic container that is constructed according to a preferred embodiment of the invention.

Referring now to the drawings, wherein like reference numerals designate corresponding structure throughout the views, and referring in particular to FIG. 1, a round, hot fillable plastic container 10 that is constructed according to a preferred embodiment of the invention includes a container body 12 having a main body portion 14, an upper portion 16 and a bottom 22. In the preferred embodiment, the upper portion 16 includes a finish portion 18 having an external thread 20. A rounded dome portion 58 is preferably provided between the main body portion 14 and the upper portion 16.

In this embodiment, the entire container 10 is preferably fabricated from a material such as polyethylene terephthalate, commonly known by the acronym PET, from a plastic preform using the well-known reheat stretch blow molding process. Alternatively, the container 10 can be fabricated from a material such as polypropylene, and could be manufactured using a conventional extrusion blow molding process, the details of which are well known in this area of technology.

Figure 2:
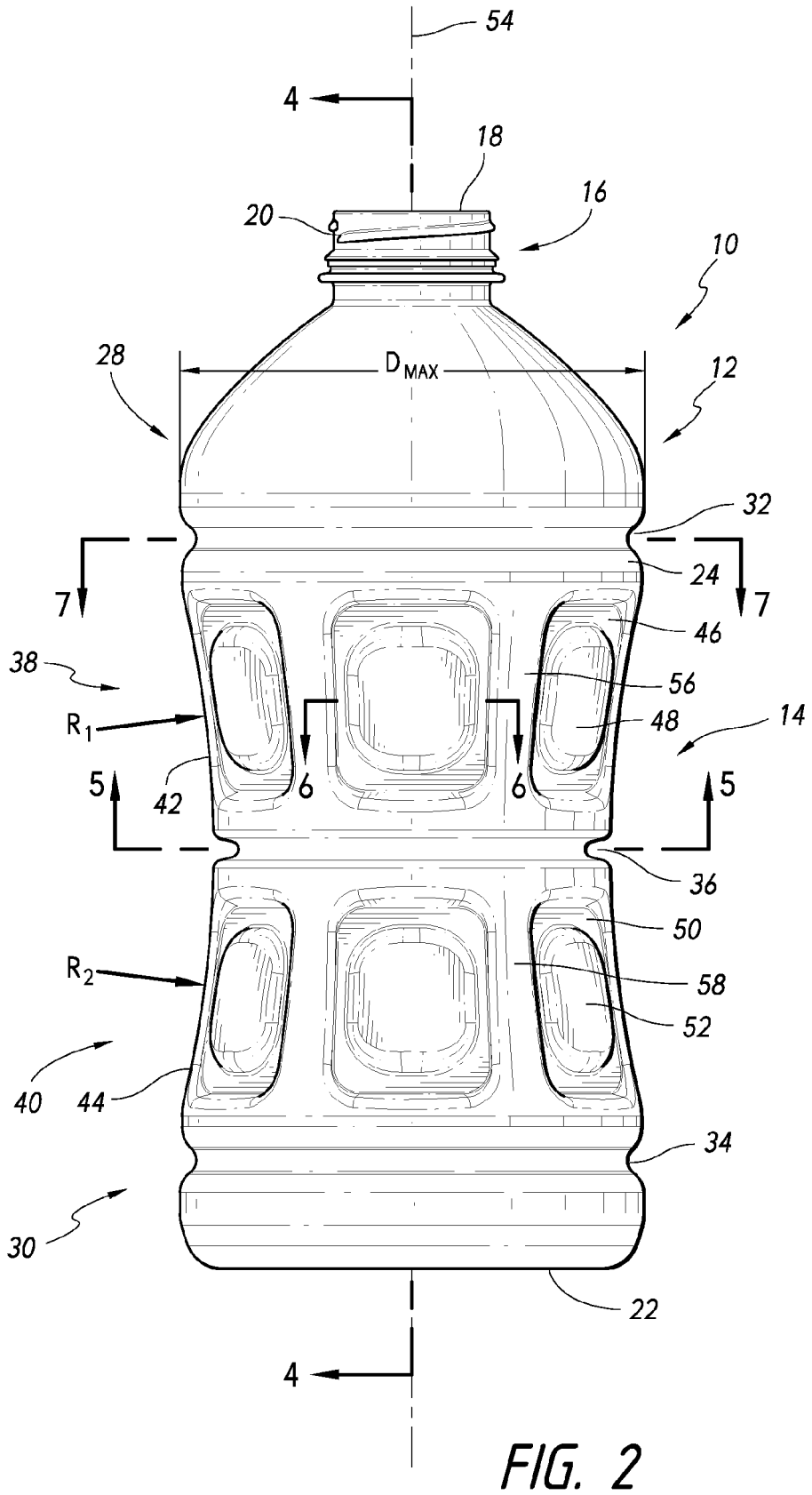
FIG. 2 is a front elevational view of the plastic container that is shown in FIG. 1.
Figure 3:
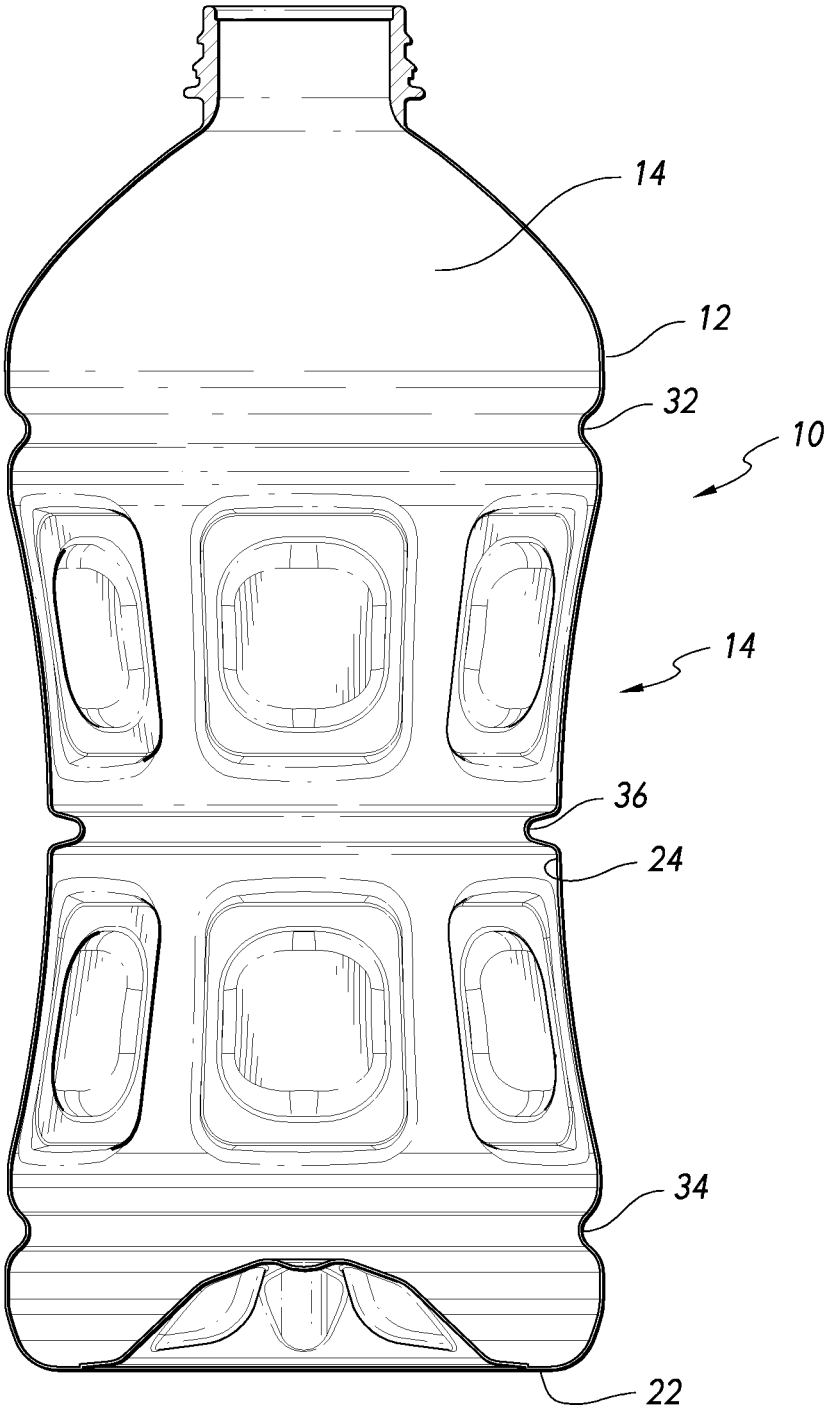
FIG. 3 is a cross-sectional view taken along lines 3-3 in FIG. 1.

The main body portion 14 and the rest of the container 10 is fabricated as a single, unitary piece having a thin plastic sidewall 24. As is best shown in FIGS. 1 and 2, the main body portion 14 has a plurality of vacuum panels 46, 50 defined therein and is constructed to have generally hourglass shape with a central portion 26 that is narrower, as measured transversely to the longitudinal axis 54 of the container 10, than either an upper portion 28 or a lower portion 30 of the main body portion 14. The hourglass shape optimizes grippability of the container 10.

The main body portion 14 preferably has a first groove 32 that is defined in the upper portion 28, and a second groove 34 that is defined in the lower portion 30. In the preferred embodiment, both the first and second grooves 32, 34 extend circumferentially within a transverse plane about an entire circumference of the container body 12. The main body portion 14 additionally preferably includes a third groove 36 that is located in the central portion 26 of the main body portion 14. The third groove 36 also preferably is configured so as to extend circumferentially within a transverse plane about an entire circumference of the container body 12. Each of the grooves 32, 34, 36 is preferably constructed so as to be of constant depth in shape throughout their circumference. In other words, each of the grooves 32, 34, 36 preferably has a substantially annular shape that is symmetrical about the longitudinal axis 54 of the container body 12.

The container 10 is preferably a multi-serve container, preferably defining an internal volume that is at least about 32 ounces, more preferably at least about 48 ounces and most preferably at least about 64 ounces.

The main body portion 14 has an upper gripping portion 38 defined between the first groove 32 and the third groove 36, and a plurality of vacuum panels 46 are preferably defined in the upper gripping portion 38. Similarly, the main body portion 14 has a lower gripping portion 40 that is positioned between the second groove 34 and the third groove 36. The lower gripping portion 40 preferably includes a plurality of vacuum panels 50.

In the preferred embodiment, the upper gripping portion 38 as a shape that is substantially symmetrical to the shape of the lower gripping portion 40 about a transverse plane that contains the third groove.

The upper gripping portion 38 preferably has a concave outer surface 42 that defines a first average radius of curvature $R_1$, and the lower gripping portion 40 preferably has a concave outer surface 44 that defines a second average radius of curvature $R_2$. In the preferred embodiment, the second average radius of curvature $R_2$ is substantially the same as the first average radius of curvature $R_1$, and the respective concave outer surfaces 42, 44 together form a single curved shape that defines the hourglass shape of the container body 12 in the main body portion 14. In the preferred embodiment, the radius of curvature of each of the concave outer surfaces 42, 44 is substantially constant, but in alternative embodiments could have some variability.

The plastic container 10 defines a maximum outer transverse dimension, which in the preferred embodiment is a maximum outer diameter $D_{MAX}$, shown in FIG. 2, located immediately above the first groove 32. A portion of the container 10 that is immediately beneath the second groove 34 in the preferred embodiment is substantially equal to a maximum outer diameter $D_{MAX}$. These two locations on the container body 12 form dimensionally stable points of contact, which enable the container 10 to be efficiently handled using conventional conveyance technology in a packaging facility. The provision of the first and second grooves 32, 34 immediately adjacent to the dimensionally stable points of contact enhances the dimensional stability of those portions of the container body 12. A plastic container 10 is what is termed in the industry a round container, meaning that it has a substantially circular transverse cross-section in the areas of its maximum outer diameter $D_{MAX}$.

Preferably, a ratio $R_1/D_{MAX}$ of the first average radius of curvature to the maximum outer diameter of the container 10 is substantially within a range of about 1.0 to about 20.0, more preferably substantially within a range of about 1.5 to about 8 and most preferably substantially within a range of about 1.75 to about 5.

Each of the average radii of curvature $R_1$, $R_2$ is preferably substantially within a range of about 100 mm to about 1000 mm, more preferably substantially within a range of about 150 mm to about 700 mm and most preferably substantially within a range of about 200 mm to about 500 mm. In the most preferred embodiment, the two concave outer surfaces 42, 44 define a single radius of curvature that preferably falls within the ranges specified above.

In the most preferred embodiment, the upper gripping portion 38 includes six vacuum panels 46 that are spaced evenly about the circumference of the container body 12 and that are respectively separated from each other by columns 56. Each of the vacuum panels 46 preferably includes an outwardly extending pillow portion 48 in order to provide label support, as will be discussed in greater detail below. In the preferred embodiment, the vacuum panels 46 are substantially identical to each other in size and shape.

The hourglass shape optimizes grippability of the container 10. Grippability is optimized further by the presence of the indentations that are formed between the columns 56 and the pillow portions 48, which permit a consumer to gain finger traction and purchase with respect to the container body 12, even when a label is positioned between the container body 12 and the user's fingers.

Similarly, the lower gripping portion 40 in the most preferred embodiment includes six vacuum panels 50 that are evenly spaced about the circumference of the container body 12 and that are respectively separated from each other by columns 58. Each of the vacuum panels 50 preferably includes an outwardly extending pillow portion 52 in order to provide label support. In the preferred embodiment, the vacuum panels 50 are substantially identical to each other in size and in shape, and are also shape to be substantially symmetrical in size and in shape, about a transverse plane that includes the third groove 36, with the vacuum panels 46 that are provided in the upper gripping portion 38.

Figure 9:
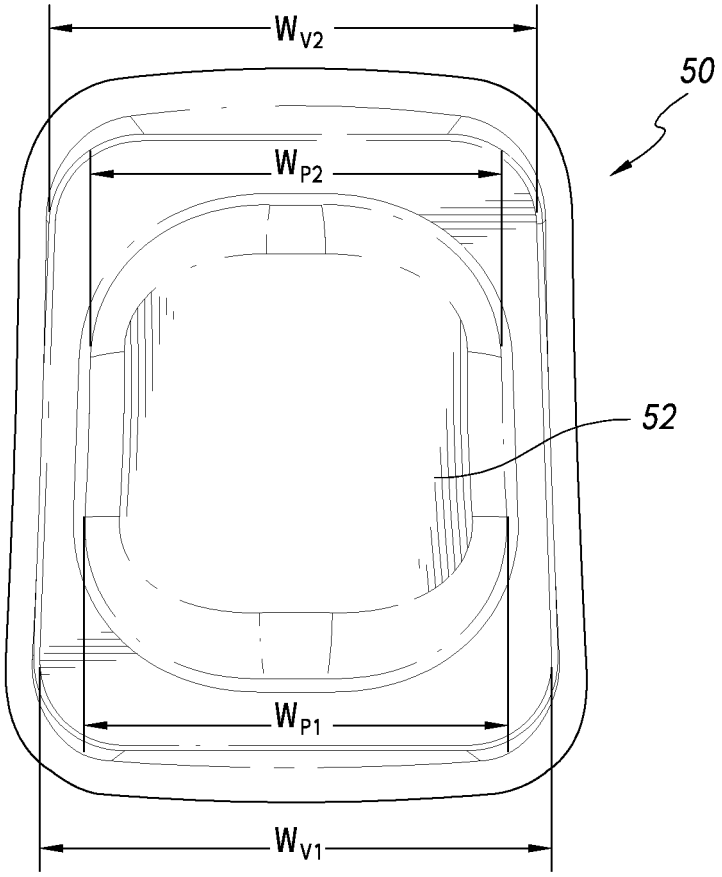
FIG. 9 is an enlargement of a portion within FIG. 2, depicting a vacuum panel in a container that is constructed according to the preferred embodiment of the invention.

Preferably, at least one vacuum panel 46, 50 is tapered so that is wider at an end that is distal to the third groove 36 that it is at an end that is proximate to the third groove 36. In the most preferred embodiment, all of the vacuum panels 46, 50 are so tapered, and the extent of the tapering is proportional to the increased surface area that is created as a result of the hourglass shape of the main body portion 14 near the upper and lower portions 28, 30. FIG. 9 is an enlarged portion of FIG. 2 depicting one of the vacuum panels 50 within the lower gripping portion 40. Each of the vacuum panels 50 also has a maximum width $W_{V1}$ at a lower end thereof that is greater than a maximum width $W_{V2}$ at an upper end thereof.

Figure 6:
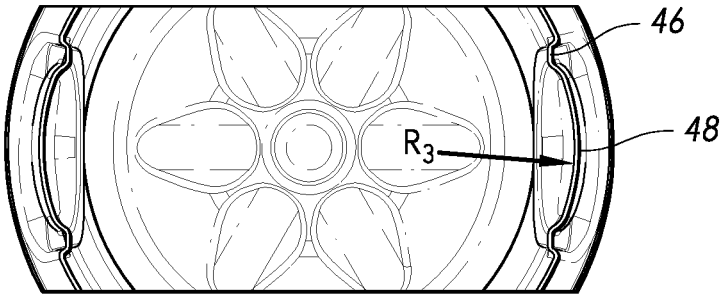
FIG. 6 is a cross-sectional view taken along lines 6-6 in FIG. 2.
Figure 7:
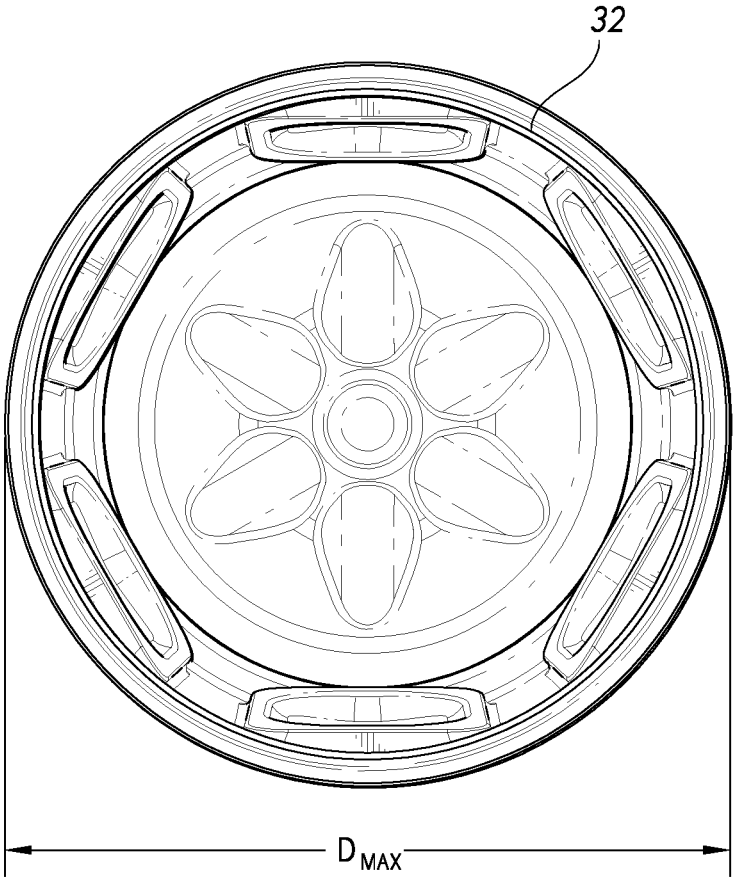
FIG. 7 is a cross-sectional view taken along lines 7-7 in FIG. 2.

Referring to FIG. 6, the outwardly extending pillow portion 48 of each of the pillows 50 preferably has a convex shape facing outwardly as viewed in transverse cross-section, and has an average radius of curvature $R_3$. A ratio $R_3/D_{MAX}$ of the average radius of curvature $R_3$ to the maximum outer diameter of the container 10 is preferably substantially within a range of about 0.15 to about 0.65, more preferably substantially within a range of about 0.2 to about 0.5 and most preferably substantially within a range of about 0.25 to about 0.45. The convex shape of the pillows 50 promotes label support.

Figure 4:
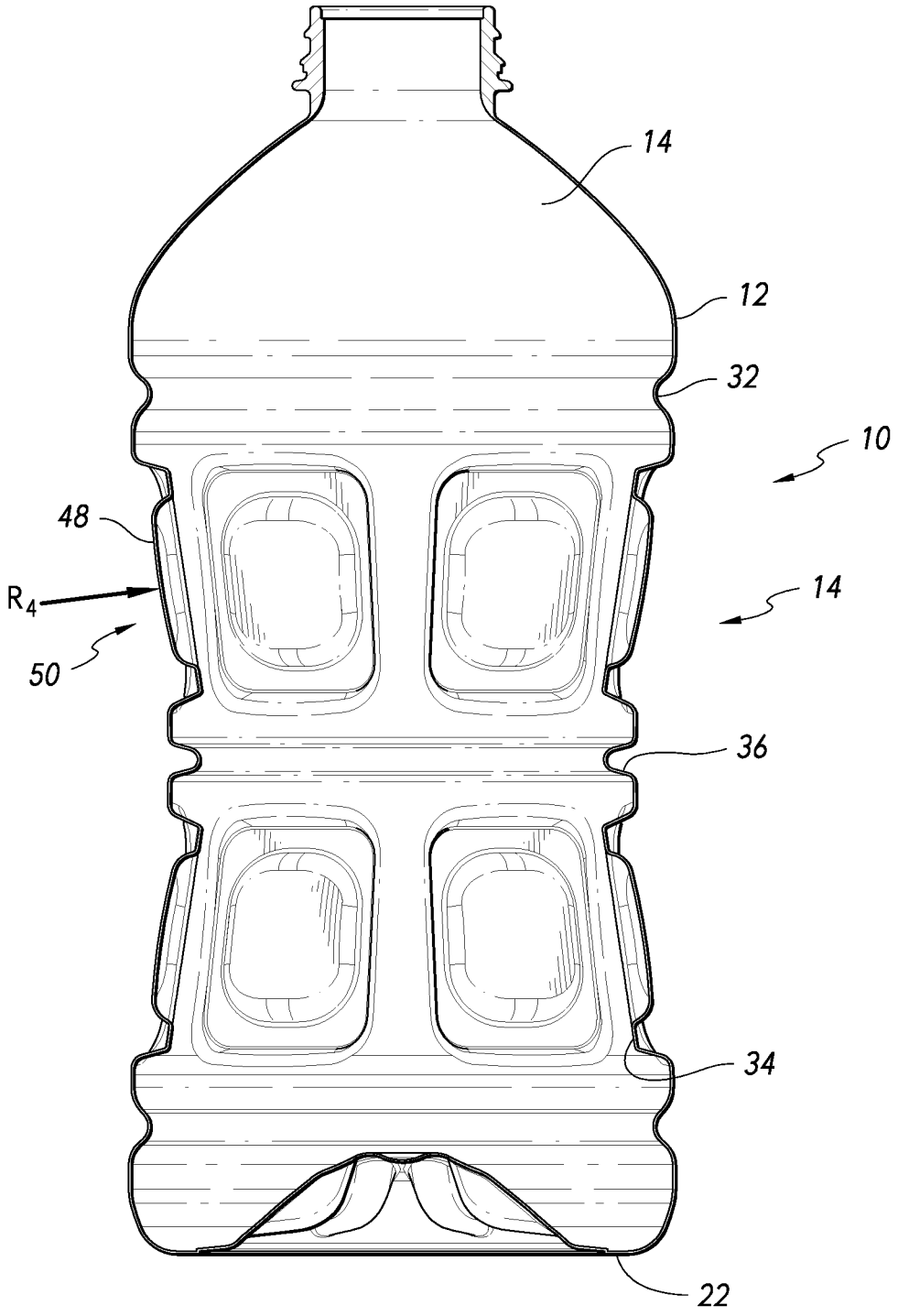
FIG. 4 is a cross-sectional view taken along lines 4-4 in FIG. 2.
Figure 5:
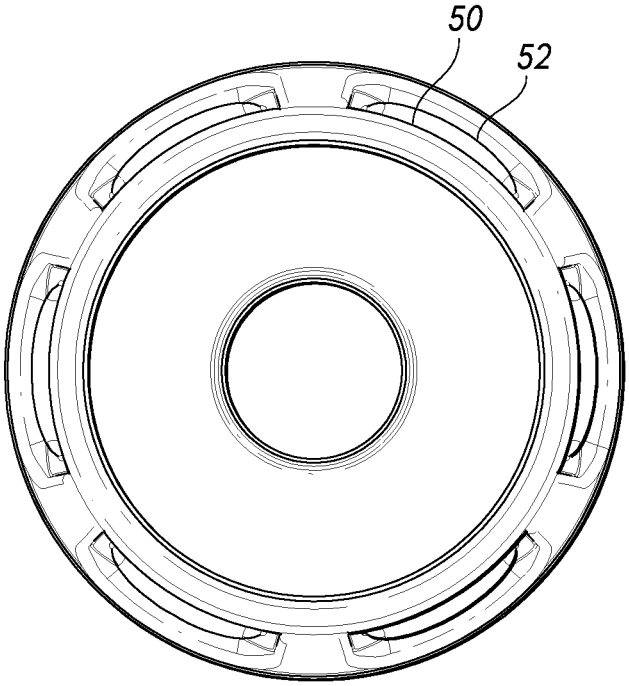
FIG. 5 is a cross-sectional view taken along lines 5-5 in FIG. 2.

As FIG. 4 best shows, each of the outwardly extending pillow portions 48 also preferably is convex facing outwardly as viewed in vertical or longitudinal cross-section, and has an average radius of curvature $R_4$. A ratio $R_4/R_1$ of the average radius of curvature $R_4$ to the first average radius of curvature $R_1$ is preferably substantially within a range of about 0.3 to about 1.4, more preferably substantially within a range of about 0.35 to about 1.2 and most preferably substantially within a range of about 0.4 to about 1.1.

In addition, each of the pillows 52 is also preferably tapered in shape so that it is wider at an end that is distal to the third groove 36 than it is at an end that is proximate to the third groove 36. As FIG. 9 shows, the pillow 52 includes a maximum width $W_{P1}$ at a lower end thereof that is greater than a maximum width $W_{P2}$ at an upper end thereof.

Figure 8:
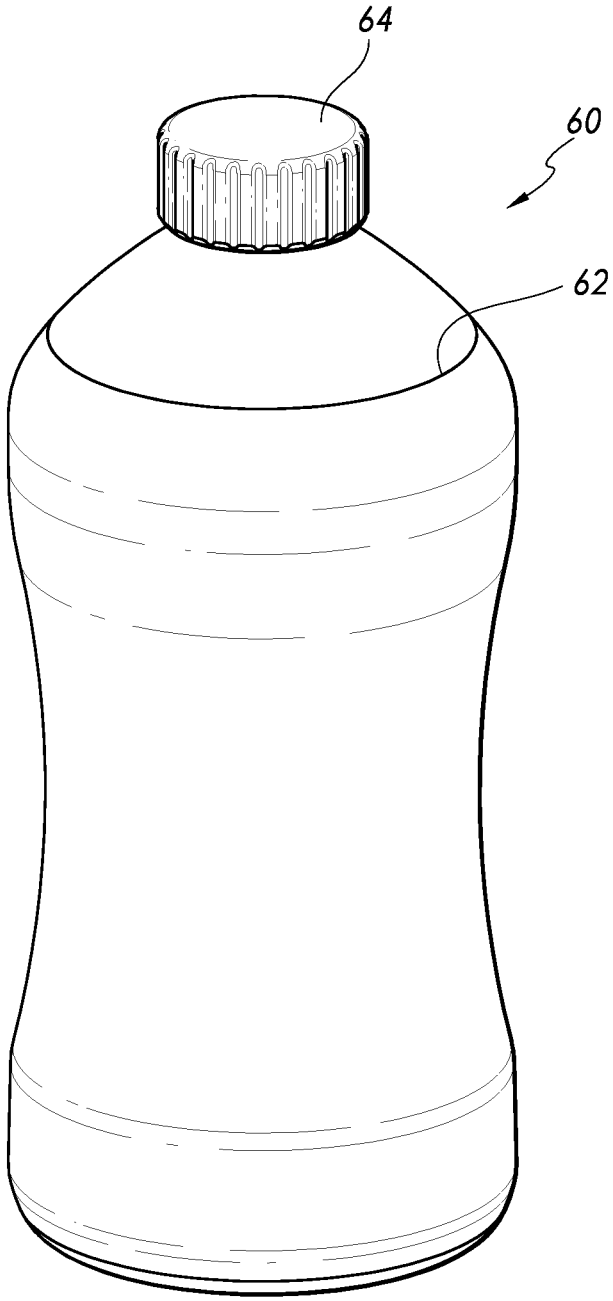
FIG. 8 is a perspective view of a container assembly including the plastic container that is shown in FIG. 1.

FIG. 8 shows a container assembly 60 that is constructed according to the preferred embodiment of the invention. The container assembly 60 includes the container 10 described above, which has been filled with product such as fruit juice, and has been wrapped in a shrink fit label 62 that conforms to the hourglass shape of the container body 12. Container assembly 60 further includes a conventional closure cap 64 and a tamper evident seal in order to keep the product sealed within the container 10.

The aforementioned structure provides a round, multi-serve hot fillable container that possesses superior grippability and that is suitable for use with shrink fit labeling.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A round, hot fillable plastic container having a maximum outer diameter in transverse cross-section, comprising:

an upper portion defining an opening;

a bottom portion; and a main body portion having a plastic sidewall that has a plurality of vacuum panels defined therein, each of the plurality of vacuum panels comprising an outwardly-extending pillow portion formed therein to provide label support, the main body portion having a generally hourglass shape with a central portion that is narrower than upper and lower portions thereof in longitudinal cross-section, the main body portion further having a first groove defined in the upper portion thereof, a second groove defined in the lower portion thereof and a third groove that is defined in the central portion thereof, whereby dimensional stability of the container is retained during handling and when the main body portion is gripped by a consumer;

wherein the main body portion has an upper gripping portion defined between the first groove and the third groove having a concave outer surface in longitudinal cross-section defining a first radius of curvature, and a lower gripping portion defined between the second groove and the third groove having a concave outer surface in longitudinal cross-section defining a second radius of curvature; and wherein each pillow portion comprises a convex shape facing outwardly in transverse cross-section, each pillow portion defining a third radius of curvature in transverse cross-section, wherein a ratio of the third radius of curvature to the maximum outer diameter is within a range of about 0.15 to about 0.65, and further wherein each pillow portion comprises a convex shape facing outwardly in longitudinal cross-section, each pillow portion defining a fourth radius of curvature in longitudinal cross-section, wherein a ratio of the fourth radius of curvature to the first radius of curvature is within a range of about 0.3 to about 1.4.

2. A round, hot fillable plastic container according to claim 1, wherein the container has a volume that is at least 32 ounces.

3. A round, hot fillable plastic container according to claim 2, wherein the container has a volume that is at least 48 ounces.

4. A round, hot fillable plastic container according to claim 1, wherein a plurality of vacuum panels are defined in the plastic sidewall within the upper gripping portion.

5. A round, hot fillable plastic container according to claim 1, wherein a plurality of vacuum panels are defined in the plastic sidewall within the lower gripping portion, and wherein the second radius of curvature is substantially the same as the first radius of curvature.

6. A round, hot fillable plastic container according to claim 1, wherein a ratio of the first radius of curvature to the maximum outer diameter is substantially within a range of about 1.0 to about 20.0.

7. A round, hot fillable plastic container according to claim 6, wherein the ratio of the first radius of curvature to the maximum outer diameter is substantially within a range of about 1.5 to about 8.0.

8. A round, hot fillable plastic container according to claim 7, wherein the ratio of the first radius of curvature to the maximum outer diameter is substantially within a range of about 1.75 to about 5.0.

9. A round, hot fillable plastic container according to claim 1, wherein the first, second and third grooves are all defined in the sidewall so as to extend circumferentially about the container.

10. A round, hot fillable plastic container according to claim 1, wherein the upper gripping portion and the lower gripping portion each have a plurality of vacuum panels defined therein.

11. A round, hot fillable plastic container according to claim 10, wherein the upper gripping portion has a shape that is substantially symmetrical to the shape of the lower gripping portion about a plane that contains the third groove.

12. A round, hot fillable plastic container according to claim 10, wherein at least one vacuum panel in the upper gripping portion is tapered so that it is wider at an upper end thereof than at a lower end thereof.

13. A round, hot fillable plastic container according to claim 10, wherein the upper gripping portion and the lower gripping portion each have six vacuum panels defined therein.

14. A round, hot fillable plastic container according to claim 1, further comprising a label supported by the outwardly-extending pillow portions.

15. A round, hot fillable plastic container according to claim 1, wherein the pillow portions are tapered so as to have larger first width on an end that is distal from the third groove then a second width on an end that is proximate to the third groove.

16. A round, hot fillable plastic container according to claim 10, wherein each of the first radius of curvature and the second radius of curvature is substantially within a range of about 100 mm to about 1000 mm.

17. A round, hot fillable plastic container according to claim 16, wherein each of the first radius of curvature and the second radius of curvature is substantially within a range of about 150 mm to about 700 mm.

18. A round, hot fillable plastic container according to claim 17, wherein each of the first radius of curvature and the second radius of curvature is substantially within a range of about 200 mm to about 500 mm.

19. A round, hot fillable plastic container according to claim 16, wherein the container has a volume that is at least about 32 ounces.

20. A round, hot fillable plastic container according to claim 19, wherein the container has a volume that is at least about 48 ounces.

21. A round, hot fillable plastic container according to claim 20, wherein the container has a volume that is at least about 64 ounces.

22. A round, hot fillable plastic container according to claim 1, further comprising a label that is shrunk fit over the main body portion.

23. A round, hot fillable plastic container according to claim 1, wherein the plastic material comprises polyethylene terephthalate.

24. A round, hot fillable plastic container having a maximum outer diameter in transverse cross-section, comprising:

a plastic sidewall defining an interior space and defining an internal volume of the container that is at least about 32 ounces, the sidewall defining a main body portion having a generally hourglass shape with a central portion that is narrower than upper and lower portions thereof in longitudinal cross-section, the main body portion further having a first groove defined in the upper portion thereof, a second groove defined in the lower portion thereof and a third groove that is defined in the central portion thereof, with an upper gripping surface having a first plurality of vacuum panels being defined between the first groove and the third groove and a lower gripping surface having a second plurality of vacuum panels being defined between the second groove and the third groove, each of the plurality of vacuum panels comprising an outwardly-extending pillow portion formed therein to provide label support; and a label that is mounted on the plastic sidewall and supported by the outwardly-extending pillow portions;

wherein each pillow portion comprises a convex shape facing outwardly in transverse cross-section, each pillow portion defining a radius of curvature in transverse cross-section, wherein a ratio of the radius of curvature to the maximum outer diameter is within a range of about 0.25 to about 0.45.

* * * * *